United States Patent [19]

Chatwin

[11] 4,267,976

[45] May 19, 1981

[54] APPARATUS FOR VAPORIZING AND ATOMIZING LIQUIDS

[76] Inventor: Francis R. Chatwin, Higher Polgassic, Lansallos, Polperro, Looe, Cornwall, England, PL13 2PY

[21] Appl. No.: 885,341

[22] Filed: Mar. 10, 1978

[51] Int. Cl.[3] ..... F02M 31/18

[52] U.S. Cl. ..... 239/102; 123/538; 123/557; 219/207; 239/134; 239/136

[58] Field of Search ..... 239/102, 134–136, 239/338; 122/248; 123/122 E, 122 F, 119 E, 119 EE; 219/205–207

[56] References Cited

U.S. PATENT DOCUMENTS

| | | | |
|---|---|---|---|
| 2,908,443 | 10/1959 | Fruengel | 239/102 |
| 3,185,201 | 5/1965 | Herbst et al. | 239/102 X |
| 3,255,804 | 6/1966 | Lang | 239/102 X |
| 4,073,273 | 2/1978 | McMahon | 123/119 E |
| 4,121,543 | 10/1978 | Hicks, Jr. et al. | 123/119 E |

*Primary Examiner*—Andres Kashnikow

*Attorney, Agent, or Firm*—Cushman, Darby & Cushman

[57] ABSTRACT

A fuel vaporizing and atomizing device which is particularly suitable for ammoniacal fuels comprises a chamber having a resonant plate therein, possibly forming part or all of one wall of the chamber, which plate is in physical contact with a transducer operating to vibrate the plate at an ultrasonic frequency in order to encourage vaporization which is further enhanced by passing the partly vaporized fuel through a silent discharge device operating at a very high voltage, following which the fuel passes over a catalyst such as platinum.

9 Claims, 5 Drawing Figures

6c
10
10a
6b
6
9c
9
9d
6a
9e
9e
9a
9b
9c
4
5
1
8a
8
3
2
S
7a
7
A

APPARATUS FOR VAPORIZING AND ATOMIZING LIQUIDS

The present invention relates to apparatus for vaporising and atomising liquids, particularly liquid fuels for furnaces, although the invention may be applied, with some development and modifications, to internal combustion engines which may be of the piston, jet or turbo-jet types.

In accordance with the present invention, apparatus for vaporising and atomising liquids comprising a casing having an internal chamber one surface of which consists of or includes a resonant plate to which is attached a transducer operable when energised to vibrate the plate at an ultrasonic frequency, a fuel supply pipe which projects into the said chamber, and a vapour discharge duct which extends from a wall of the chamber other than that having no resonant plate.

To enable the apparatus to be employed for vapourising and atomising an ammoniacal liquid (such as, for example, hydrated ammonia) capable of being used as fuel for a furnace, or indeed for an internal combustion engine, it includes a heater, which may be composed of tungsten, which may have an electric heating element embedded therein and is located within the chamber below the outlet end of the supply pipe, and an electric silent discharge device and a platinum catalyst (such as a sheet of platinum gauze) through which, before flowing from the probe, the atomised liquid vapour is constrained to pass in succession so as to be decomposed into a mixture of hydrogen, nitrogen and water vapour.

In order that the invention may be understood and carried into practice more readily, one typical embodiment thereof will be described with reference to the accompanying drawings, in which.

Figure 1:
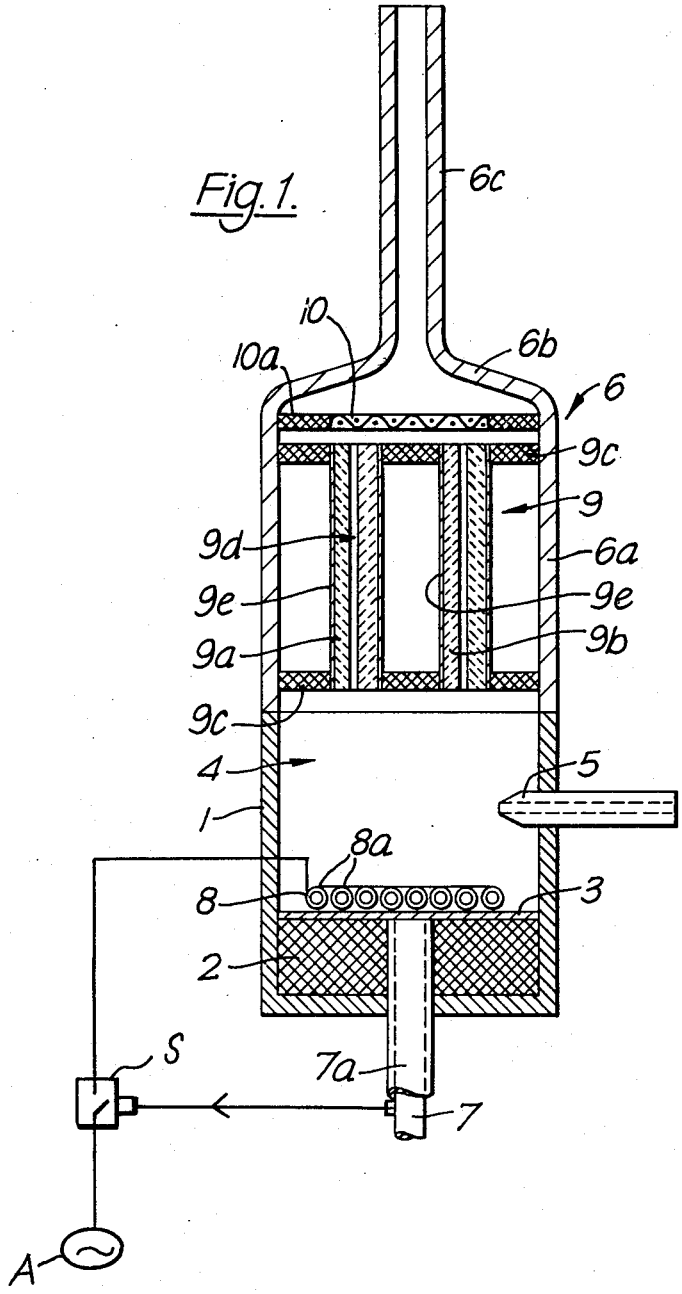
FIG. 1 is a cross-sectional elevation of apparatus for vaporising and atomising a liquid fuel to be supplied to a furnace or an internal combustion engine.

The apparatus shown in the drawing comprises a cylindrical casing 1 which accommodates, in the lower part thereof, an electro-mechanical or electro-magnetic transducer 2 of any known type and suitable construction capable of vibrating, at an ultrasonic frequency, a metal (preferably titanium) plate 3 forming or included in the floor of a reaction chamber 4 in the upper part of the casing.

The outlet end 5 of a supply pipe through which liquid fuel flows or is injected, at a controlled rate in use of the device, extends through the wall, and into the interior, of the chamber above the plate 3; and an outlet duct 6 projects upwardly from and concentrically with respect to the open top of the casing.

The lower larger diameter portion **6*a* of the duct is of the same cross-sectional dimensions as the casing and its lower open end is secured to the upper open end of the casing with the rims of the said open ends in intimate contact with one another. Beyond the said larger diameter portion, the duct converges, at 6*b*, into a smaller diameter, concentric portion or nozzle 6*c***.

The nozzle extends into an air intake passage (not shown) of a furnace or the induction system of an engine to which the fuel is to be supplied, and a rod 7, composed of copper or other metal having a thermal conductivity comparable to that of copper, and adapted to be heated, externally of the apparatus, by the products of combustion exhausted from the furnace or engine, extends through the lower wall of the cylindrical casing 1 coaxially of the UHF transducer 2 to abut the underside of the resonant plate. At least between its heat source and the plate, the copper rod 7 is enclosed in a sheath **7*a*** of heat insulating material.

A heater comprising a spirally wound tubular body 8, the adjacent turns of which are spaced from one another, and in which an electric heating element **8*a*** is embedded, lies in contact with and concentric to, the upper surface of the plate, below the outlet end of the pipe.

The probe portion **6*a*, houses an electric silent-discharge device 9 and a catalyst 10. The silent-discharge device is located below the catalyst and, in the embodiment of the invention shown in the drawing, comprises two concentric glass tubes 9*a*, 9*b* which are fixed in ceramic or like such heat resistant carriers 9*c*, spanning the interior of the said probe portion. The internal diameter of the outer tube 9*a* is greater than the external diameter of the inner tube 9*b* so that an annular passage 9*d* extends through the device, and the remote surfaces of the two tubes are covered with a coating 9*e*** of current-conducting medium, such as aluminium paint, and connected across a suitable intermittent supply (not shown in the drawings) of high tension of, or in the region of, 100,000 volts. In an alternative embodiment there may be a plurality of pairs of such tubes (six are envisaged) in order to avoid the possibility of any choking effect on the engine. At the very high voltages involved any air present between the tubes will be broken down producing ozone.

Preferably the catalyst consists of a disc of platinum wire gauze, which is fixed within an annular, ceramic or like such heat-resistant carrier **10*a* which also spans the interior of the wider portion 6*a*** of the probe.

The apparatus is capable of being used for supplying an ammoniac liquid fuel to a furnace or to an internal combustion engine of the piston, jet or turbo-jet type, or a hydrocarbon fuel to a furnace or an internal combustion engine of the piston, jet or turbo-jet type.

When the apparatus is to be used with a liquid ammoniac fuel, the liquid fuel is injected through the supply pipe and sprayed into the interior of the reaction chamber. To fire the furnace initially, or to start the engine when cold, the tungsten heater body 8 is initially raised to a predetermined temperature by the embedded element **8*a*. Then the transducer 2 is energised and vibrates the resonant plate 3 at an ultrasonic frequency, the silent discharge device is connected across its source of current supply, and the liquid fuel is injected and sprayed into the chamber. The spray falls onto and is vaporised and atomised by the vibrating plate and the atomised vapour is partially decomposed by the heat generated by the heater; should spots of liquid drip from the pipe, they fall on to and are also vaporised, atomised and partially decomposed by the plate and heater. The atomised and partially decomposed vapour flows through the annular passage 9***d* and the platinum gauze catalyst 10 so that it is substantially entirely decomposed to provide a mixture of which hydrogen and nitrogen are the major constituents.

This vaporised mixture is discharged from the nozzle 6*c* into the air intake passage where it is mixed intimately with the air flowing through the passage to provide a combustible mixture which is supplied to and burnt in the furnace or the engine. The combustion products in the furnace flue, or the exhaust from the engine, which are comprised almost entirely of nitrogen and water vapour are utilised for heating the rod 7 (see FIG. 3).

When, or shortly after, the furnace has been fired or the engine has been started, and the rod 7 has been heated to the temperature of the tungsten body 8, a thermal switch S connected to a temperature sensor T disconnects the element 8*a* from its source A of current supply and the heater body is maintained at the predetermined temperature by the heated rod.

When the apparatus is to be used for supplying a liquid hydrocarbon fuel, such as petrol, to a furnace or an internal combustion engine, the fuel is supplied to the chamber 4, through the pipe 5, from a reservoir in which it is maintained at a constant level. Before the supply is commenced, the transducer is energised but neither the embedded element 8*a* nor the silent discharge device, is connected to its source of current supply.

As the fuel flows from the supply pipe, it falls on to, and is vaporised and atomised by, the vibrating resonant plate and the atomised vapour is delivered through the nozzle 6*c* into the air passage where it is mixed intimately with the air flowing through the passage to the furnace or the engine, to produce a combustible mixture which is capable of being burnt to, or substantially to, completion in the furnace or engine so that the carbon monoxide content of the products of combustion in the furnace flue or exhausted from the engine, is either zero or negligible.

The apparatus described above and shown in the accompanying drawings may, if desired, be modified by locating the supply pipe at any alternative position between the heater and the discharge duct, and/or by locating the silent discharge device and catalyst and/or the transducer 2 and its associated resonant plate 3 at any alternative position between the outlet ends of the supply pipe 5 and the nozzle 6*c* provided precautions are taken to ensure that the atomised fuel vapour is unable to enter the duct without passing the resonant plate and through the silent discharge device and catalyst in succession, and/or by omitting the copper or equivalent, heat-conducting rod and its associated thermal switch.

Figure 2:
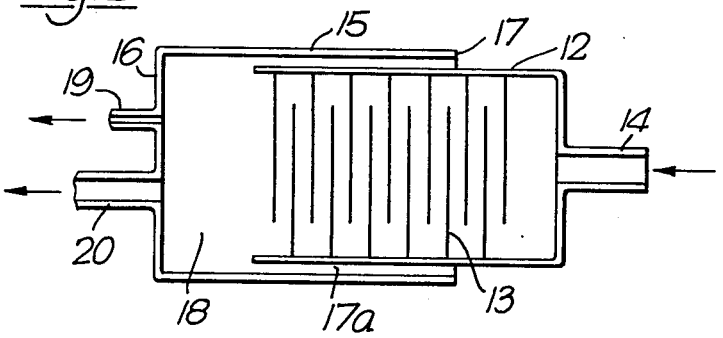
FIG. 2 is a diagrammatic cross section of an exhaust emission expansion chamber by means of which unburnt or partly burnt fuel can be recycled to the combustion chamber of the furnace or engine with the air supply thereto.

In order to avoid the possibility of unburnt or partly burnt fuel from entering the atmosphere via the furnace flue or exhaust emission of an engine supplied by the device of the invention it is envisaged that an exhaust recycling unit will be provided. Such a device is only appropriate when ammoniacal fuels are to be used, but can operate to ensure that combustion is substantially complete before the exhaust gases are permitted to pass into the atmosphere. FIG. 2, illustrates the application of such a device to an internal combustion engine. In FIG. 2 there is shown an emission expansion chamber comprising an inner open ended container 12 traversed by a plurality of baffles 13 and having an inlet duct 14 at one end thereof. The container 12 is open at the end remote from the inlet duct 14. Surrounding the container 12 is an outer sheath 15 which has a substantially closed end 16 adjacent the open end of the container 12, and an open end 17 surrounding the substantially closed end of the container 12 into which feeds the inlet duct 14. The sheath 15 is somewhat larger than the container 12 so that an annular air space 17*a* is formed between them, this annular air space 17*a* between the sheath 15 and container 12 at the end 17 of the sheath 15 forming an inlet for air to enter a chamber 18 defined in the space between the end 16 of the sheath 15 and the open end of the container 12.

The end wall 16 of the sheath 15 has two outlet pipes, a narrow pipe 19 which leads to the atmosphere, and a wider pipe 20 which, as will be discussed in greater detail below, feeds gases to the induction manifold of the engine to which the exhaust emission expansion chamber is fitted. In use, exhaust gases enter the chamber through the inlet duct 14 and, being successively deflected by the baffles 13, expands in the expansion chamber defined by the container 12. The pipe 20, since it is connected to the induction manifold of the engine in which a vacuum exists during operation of the engine, creates a low pressure region in the end of the expansion chamber adjacent the end wall 16 of the sheath 15 and the baffles 13 are so placed and in sufficient number to preserve the pressure gradient from the inlet duct 14 to the chamber 18. As will be seen from FIG. 3 the pipe 20 is fed into the induction manifold of an engine, generally indicated 21, to which fuel is fed by the duct 6*c* of the device illustrated in FIG. 1. Because of the low pressure region in the chamber 18, air is drawn through the annular interspace between the container 12 and the sheath 15 and admixed with the exhaust gases before being drawn into the pipe 20 and further admixed with atomised fuel provided by the vaporiser and atomiser device of FIG. 1. Any unburnt fuel remaining in the exhaust gases is thus recycled to the engine, excess exhaust gases passing down the pipe 19 to the atmosphere.

Figure 3:
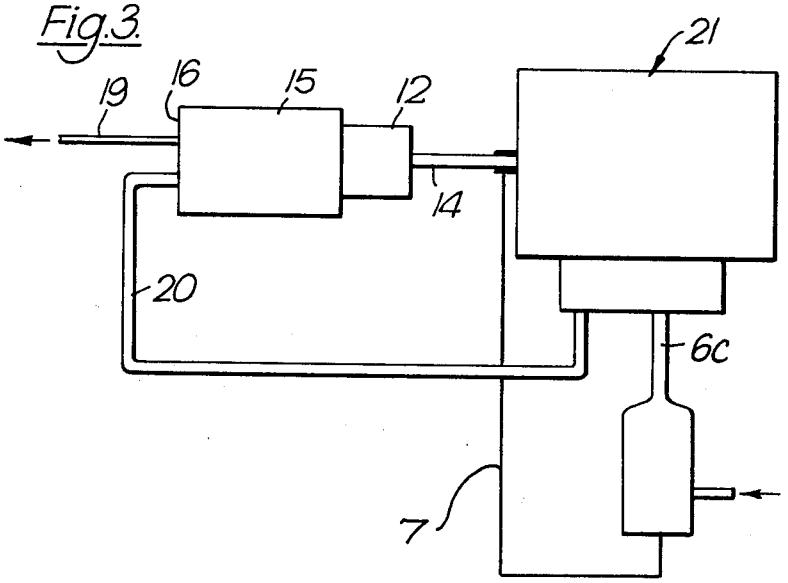
FIG. 3 is a schematic diagram illustrating diagrammatically the manner in which the vaporiser device of FIG. 1 and the exhaust emission expansion chamber of FIG. 2 may be coupled to a furnace or to an engine.
Figure 4:
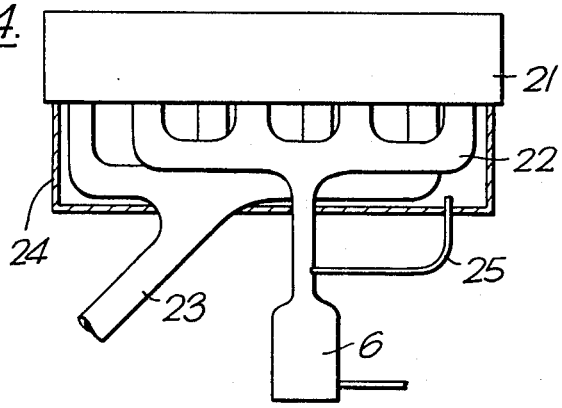
FIG. 4 is a schematic diagram illustrating a shielded manifold arrangement for use in connection with the device of FIG. 1 for maintaining the fuel in a vaporised state.

In order to assist in maintaining the fuel in the vaporised state after having left the UHF atomiser the inlet and exhaust manifolds of an internal combustion engine such as the engine 12 illustrated in FIG. 3 may be lagged with an outer casing. As shown in FIG. 4 the inlet manifold 22 and exhaust 23 are, in the engine illustrated, closely adjacent one another and surrounded by an insultating casing 24 sealed to the engine 21 to provide an enclosure which is partially evacuated by connecting the interior thereof, by means of a vacuum pipe 25, to the induction duct 6*c* at which a reduced pressure prevails so that the interior of the housing 24 is maintained at a reduced pressure. The inlet manifold can thus attain thermal equilibrium with the exhaust manifold with little loss of heat thereby assisting in maintaining the vaporised fuel in its vapour state until it enters the cylinders of the engine. The space within the casing 22 may be filled, or substantially filled with a thermally conductive material to assist in the even distribution of heat to the inlet manifold and avoid local hot spots which might cause pre-ignition of the incoming fuel.

Figure 5:
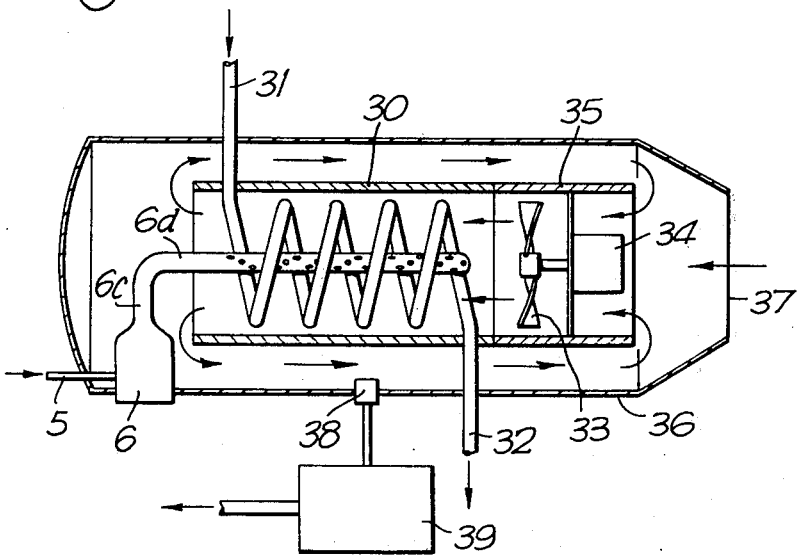
FIG. 5 is a schematic diagram illustrating the manner in which the device of FIG. 1 can be employed in a steam generating boiler installation.

In FIG. 5 there is shown, in schematic form, the use of the UHF atomiser device in a steam generating boiler. This construction comprises a tubular high pressure titanium boiler 30 through which extends a duct *6d* which is an extension of the duct *6c* leading from the atomiser device 6 to which fuel or fuel and air mixture is fed via the inlet pipe 5. The duct *6d* has a plurality of burners spaced along its length at which the fuel or fuel/air mixture is burnt within the tubular high pressure titanium boiler 30. The boiler 30 is fed with water via inlet pipes 31 and the heated water or steam is drawn from the boiler via outlet pipes 32. Added combustion air and/or recirculated combustion products are circulated through the tubular high pressure titanium boiler 30 by means of a fan 33 driven by a motor 34 mounted in a ducted housing 35 which guides the air through the boiler 30. The whole assembly is encased in an outer stainless steel cylindrical container 36 which is substantially closed apart from an opening 37 at one end through which combustion air is drawn by the fan 33 to be joined by recirculated combustion products which have passed out of the end of the tubular high pressure titanium boiler 30 and recirculated in the space between this and the cylindrical housing 36. The exhaust from the container 36 flows via a valve 38 leading to a condensor chamber 39.

What is claimed is:

1. Apparatus for vaporising and atomising liquids comprising:

a casing, means within said casing defining an internal chamber, a heater within said chamber, means for supplying electrical current to operate said heater, a resonant plate within said chamber, a transducer attached to said resonant plate, said transducer operating, when energised, to vibrate said plate at an ultrasonic frequency, a liquid injector pipe projecting into said chamber, a vapor discharge duct extending from said chamber, a thermally conductive element in thermal contact with said resonant plate and extending into contact with a heat source spaced from said apparatus, and a thermal switch sensitive to the temperature of said thermally conductive element, said switch operating to disconnect said heater from its supply of current when said thermally conductive element attains a critical temperature in the vicinity of the operating temperature of said heater.

2. The apparatus of claim 1, wherein there is further provided an electric silent discharge device between the outlet end of said liquid injector pipe and said vapour discharge duct, said electric silent discharge device being so positioned that fuel must flow therethrough on passing from said liquid injector pipe to said discharge duct.

3. The apparatus of claim 2, wherein said heater comprises a tungsten body having an electric heating element embedded therein.

4. The apparatus of claim 2, wherein a catalyst capable of decomposing ammoniacal liquid or vapour, is provided between said electric silent discharge device and said vapour discharge duct.

5. The apparatus of claim 4, wherein said catalyst is platinum.

6. Apparatus for vaporising and atomising liquids, particularly ammoniacal liquids, comprising:

a casing, means within said casing defining an internal chamber, a liquid injector pipe projecting into said chamber for injecting liquid thereinto, a heater within said chamber, a resonant plate within said chamber adjacent said heater, a transducer coupled to said resonant plate, said transducer operating, when energised, to vibrate said plate at an ultrasonic frequency so that said heater and said plate atomize and vaporize said injected liquid, a vapor discharge duct extending from a wall of said chamber remote from said heater and said resonant plate, and an electric silent discharge device between the outlet end of said fuel injector pipe and said vapor discharge duct, whereby said electric silent discharge device is so positioned that vaporized liquid must flow therethrough on passing from said injector pipe to said discharge duct.

7. The apparatus of claim 6, wherein said heater comprises a tungsten body having an electric heating element embedded therein.

8. The apparatus of claim 6, wherein a catalyst capable of decomposing ammoniacal vapor, is provided between said electric silent discharge device and said vapor discharge duct.

9. The apparatus of claim 8, wherein said catalyst is platinum.

* * * * *